United States Patent [19]

Beermann

[11] 4,320,576

[45] Mar. 23, 1982

[54] RAZOR KNIFE WITH SELF-RETRACTING BLADE

[75] Inventor: Ewald H. Beermann, Solingen, Fed. Rep. of Germany

[73] Assignee: Firma Martor-Argentax E. H. Beermann KG, Solingen, Fed. Rep. of Germany

[21] Appl. No.: 146,333

[22] Filed: May 2, 1980

Related U.S. Application Data

[63] Continuation of Ser. No. 928,379, Jul. 27, 1978, abandoned.

[30] Foreign Application Priority Data

Aug. 12, 1977 [DE] Fed. Rep. of Germany ..... 2736395

[51] Int. Cl.[3] ..... B26B 3/06

[52] U.S. Cl. ..... 30/162; 30/320; 30/335

[58] Field of Search ..... 30/162, 320, 335

[56] References Cited

U.S. PATENT DOCUMENTS

| | | | |
|---|---|---|---|
| 938,384 | 10/1909 | Jarvis | 30/320 |
| 1,701,771 | 2/1929 | Di Stefano | 30/162 |
| 1,755,535 | 4/1930 | Bratrud | 30/320 |
| 1,906,573 | 5/1933 | Gits | 30/320 |
| 2,632,244 | 3/1953 | Belsky | 30/320 |
| 3,192,624 | 7/1965 | Gringer | 30/162 |

FOREIGN PATENT DOCUMENTS

| | | | |
|---|---|---|---|
| 671327 | 10/1963 | Canada | 30/162 |
| 464538 | 7/1951 | Italy | 30/162 |

*Primary Examiner*—Jimmy C. Peters
*Assistant Examiner*—J. T. Zatarga
*Attorney, Agent, or Firm*—Montague & Ross

[57] ABSTRACT

A razor knife has an elongated housing formed of a front housing part and a rear housing part and having a longitudinally extending guide. The rear housing part is backwardly separable from the front housing part and carries a blade holder which has a seat for a razor blade and an actuator button exposed at a slot formed in the front housing part. This holder is displaceable by sliding of the actuator button from a back position with the blade wholly enclosed by the housing into a front position with a portion of the blade projecting forwardly from the housing. A tension spring inside the insert or back housing part continuously urges the holder into the back position. Interengaging formations on the operating button and the housing, however, allow the blade to be held in the outer position so long as a slight inward force is exerted on the slidable actuator button.

8 Claims, 7 Drawing Figures

RAZOR KNIFE WITH SELF-RETRACTING BLADE

This is a continuation of application Ser. No. 928,379, filed July 27, 1978, now abandoned.

FIELD OF THE INVENTION

The present invention relates to a razor knife with a retractable blade.

BACKGROUND OF THE INVENTION

A razor knife is a standard commercial item widely used both by the professional worker as well as the home hobbyist or craftsman. It normally comprises an elongated housing adapted to be held in the hand and provided on one side with a slide button that is connected via internal structure in the knife to a razor blade that can be moved from a back position wholly within the handle housing to a front position projecting partially therefrom. As the razor blades used by such a knife are usually very sharp it is essential to be able to withdraw the blade back into the housing when the knife is not in use to prevent accident and injury.

It is relatively common, however, that the blade is left in the extended or front position by the user. This leaves the dangerously sharp blade projecting and creates a considerable hazard in case the user attempts to place the knife back in his or her pocket or accidentally bumps the projecting blade. The solution of providing an automatic withdraw mechanism which continuously urges the blade backwardly so that the user must clamp the blade against this return force has been deemed unsatisfactory because of the difficulty of holding the blade in the out position while using the knife.

OBJECTS OF THE INVENTION

It is therefore an object of the present invention to provide an improved razor knife.

Another object is to provide such a knife which eliminates the possibility of an accident of the above-described type.

SUMMARY OF THE INVENTION

These objects are attained according to the instant invention in a razor knife wherein the elongated housing is formed with a longitudinally extending guide and with a laterally open slot and the blade holder having a seat for a razor blade and an actuator exposed at the slot is displaceable in this housing from outside between a back position with the blade wholly enclosed by the housing and a front position with a portion of the blade projecting forwardly from the housing. Biasing means in the form of a spring continuously urges the holder into a back position and interengaging formations on the housing and on the holder retain the holder in front position so long as a predetermined transverse force is exerted on the actuator.

Thus so long as the predetermined transverse force is exerted on the actuator the blade remains exposed, but as soon as this force is released the biasing means retracts the blade. The blade can only be extended for use by continuous actuation of the actuator, normally a slide-type thumb button, by the user. It therefore becomes impossible inadvertently to leave the blade exposed, so that the possibility of accident is greatly reduced.

According to this invention the housing is formed as a front outer housing part having the above-mentioned slot and a back insert part that is fittable into a recess that opens at the back of the housing and which itself carries the blade holder, actuator, and blade. These two parts fit tightly together so as to form a very neat and easy-to-handle assembly. For replacement of the blade however it is a very simple matter to pull out the insert part, which is merely held frictionally inside the front outer housing part, and to place a new blade in the seat of the blade holder.

The insert part according to this invention is formed with a forwardly open longitudinally extending blind bore that receives a tension spring hooked at its rear end over a pin traversing the bore and at its front end on a lateral projection from the actuator of the blade holder, so as continuously to urge the blade holder backwardly in the housing.

According to another feature of this invention the actuator, constituted as a thumb button, has a curved back surface and can rock on the insert part. The interengaging formations that allow the actuator to lock the blade in place in the out or front position of the blade is constituted by a step on the insert part which can engage the back edge of the actuator button when same is rocked down. The amount of force necessary to hold the actuator, edge against this step to lock the blade in the out position is relatively small, in fact, much smaller than the amount of force that would be necessary to hold the blade against the force of the return spring. Thus the user need merely exert a very small pressure against the actuator button to maintain the blade out, yet as soon as this pressure is released the button will rock away from the step and the relatively strong force of the return spring will be able to pull it backwardly into the housing.

The knife according to this invention can use a standard single-edge razor blade having one cutting edge and its opposite edge provided with a U-section reinforcement. Accordingly, the blade holder has a tongue which lies flat against one face of the blade and is formed with the laterally projecting boss that is engageable in the normally provided hole in the blade, so as axially or longitudinally to link the two together. In addition the rear edge of the blade bears against a shoulder formed on the blade holder so that this blade is extremely rigidly held and considerable pressure can be brought to bear on it. At the same time it is relatively easy once the front edge or corner of the blade is dulled to pull out the insert part, reverse the blade, and replace the assembly in the housing to use the opposite corner or end of the blade. Similarly of course this system can be adapted to use a standard mat-knife blade, even of the breakaway type that allows the blade tip to be broken off at a preformed line to give a new cutting corner.

SPECIFIC DESCRIPTION

Figure 1:
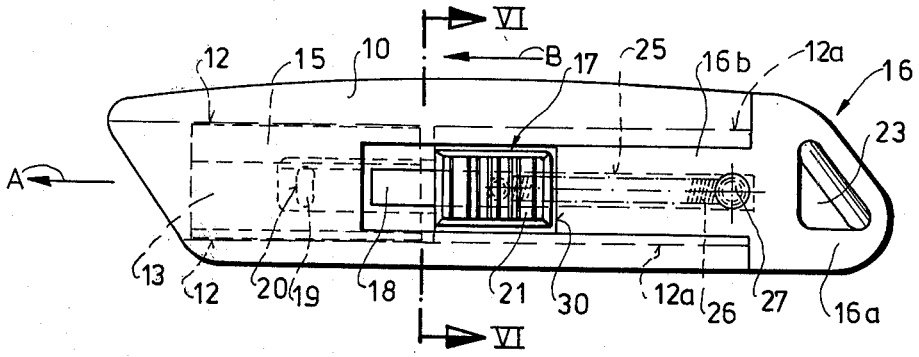
FIGS. 1 and 2 are side and top views of a razor knife according to this invention with the blade in the back or retracted position.
Figure 2:
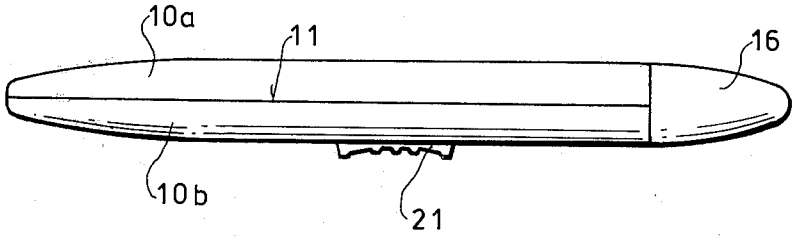

As shown in FIGS. 1 and 2 a razor knife according to this invention basically comprises a front housing part 10 formed of a right-hand front housing half 10*a* and a left-hand front housing half 10*b* secured together at a planar joint 11 extending longitudinally of the front housing part 10. Both of the halves 10*a* and 10*b* are made of a synthetic resin, a polyamide such as nylon being suitable, and are adhered together at the joint 11. The housing 10 is formed with a longitudinally extending guide slot 12 that opens at the inclined front end of the housing and is adapted to hold a single-edge razor 13 having a cutting edge 14 and opposite thereto a U-section reinforcement 15. The front edge of the housing is, as mentioned above, inclined to the longitudinal axis of the housing 10 so that when the blade 13 is extended as shown in FIG. 3 a corner of its cutting edge 14 is exposed.

Figure 3:
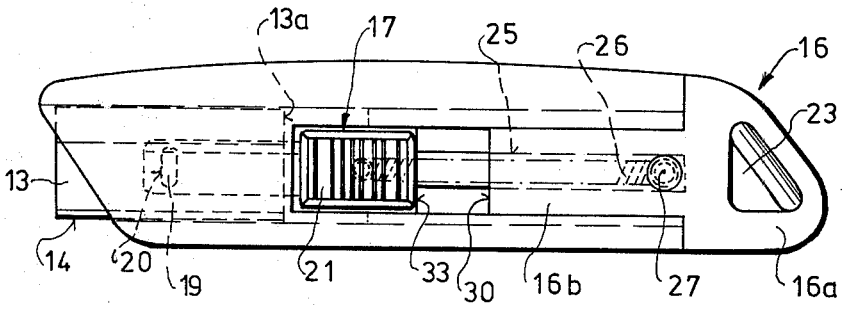
FIG. 3 is a side view similar to FIG. 1 showing the blade in the extended or front position.

The housing further comprises a synthetic-resin insertable rear housing part or insert 16 having a rear end 16*a* that is complementarily shaped to the front end of the housing so as to give the tool a generally parallelogrammatic shape as seen from the side as in FIGS. 1 and 3. This insert part 16 has a forwardly extending tongue 16*b* on which is carried a blade holder 17 as best shown in FIGS. 4–7. The holder 17 has a forwardly extending flexible holding finger 18 provided with a laterally projecting pump 19 intended to engage in a hole 20 provided in the razor blade 13, so that the holder 17 moves longitudinally jointly with blade 13. The insert 16 can be fitted in the direction of arrow C (FIG. 4) into the housing part 10 and is frictionally held therein.

The finger 18 of the holder 17 has at its rear end a guide foot 18*a* integrally formed with an operating or actuating button 21 that is exposed at a longitudinally extending and backwardly open slot 22 formed in the housing half 10*b*. A hole 23 traversing the rear end 16*a* of the insert 16 allows the tool to be hung or suspended from a string. In addition, the insert 16 is formed with a pair of oppositely vertically directed ridges 24 receivable in grooves 12*a* formed in the housing part 10.

The insert part 16 is formed at the tongue 16*b* with a forwardly open bore 25 receiving a tension spring 16 having a front end 26*a* hooked over a lateral projection or pin 28 formed on the button 21 and a rear end 26*b* hooked over a pin 17 traversing the rear part of the insert 16. This spring 26 continuously pulls the blade holder 17 backwardly. Normally it presses the rear edge 21*a* of the button 21 against an abutment or step 30 formed on the tongue 16*b* a shown in FIGS. 5 and 7.

Figures 4, 5, 6, 7:
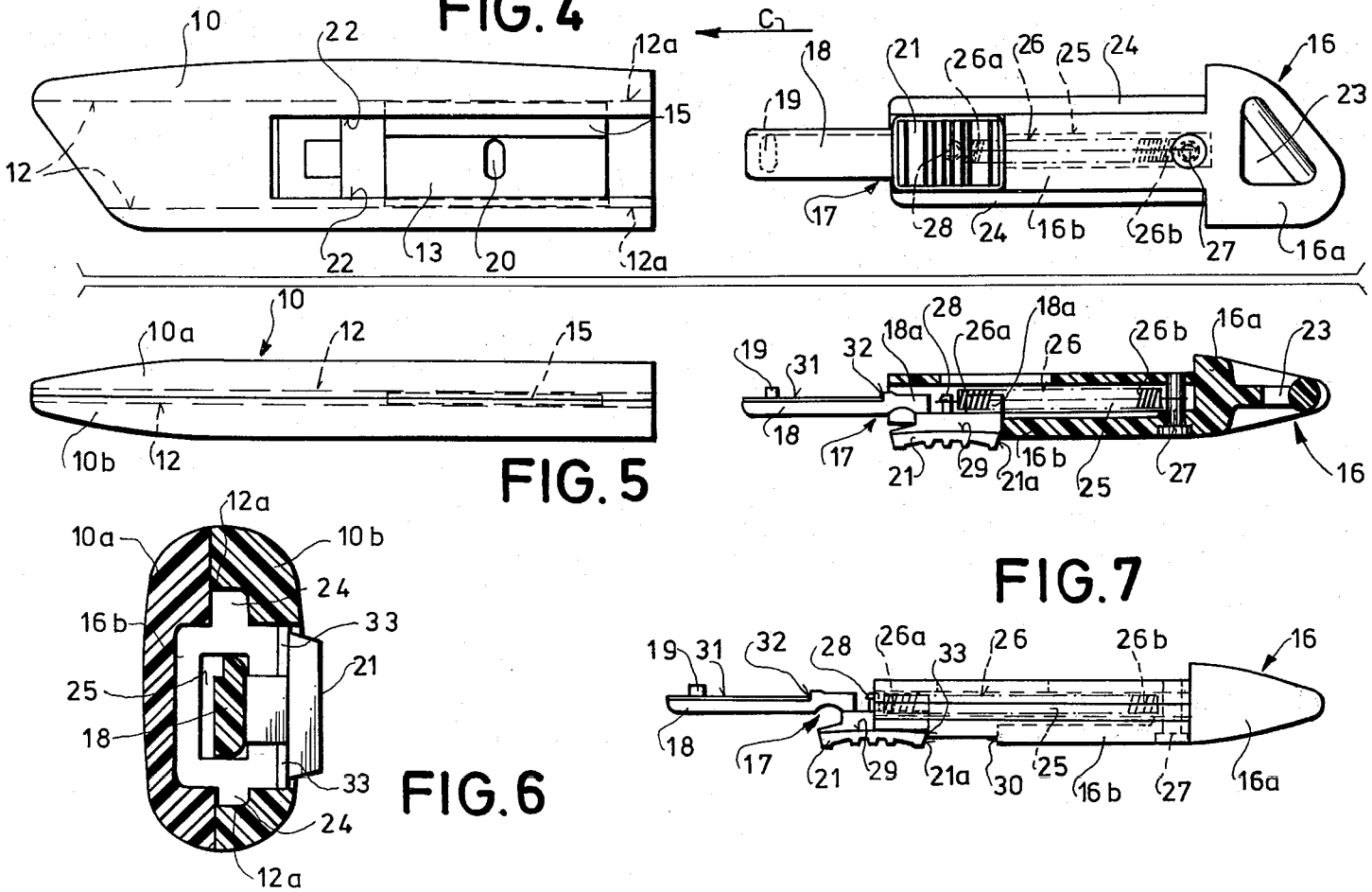
FIG. 4 is a side exploded view of the knife according to this invention with the holder in the back position.
FIG. 5 is a top, partly sectional exploded view of the knife according to this invention with the holder in the back position.
FIG. 6 is a section taken along line VI—VI of FIG. 1.
FIG. 7 is a top view of the insert part of the housing of the knife according to this invention with the blade holder in the front or extended position.

The button 21 has an inner curved surface 29 by mean of which it can rock on the side surface of the tongue 16*b*. The force of the spring 26 exerted on the projection 28 normally tries to tip the button 21 so that the rear edge 21*a* is spaced from the insert 16. This edge 21*a*, however, can be easily thrust inwardly with a relatively modest force to catch on a step or abutment 33 formed on the insert part 16 ahead of the step 30 as shown in FIG. 7. In this position the blade holder 17 is locked in the outer position. The force necessary to hold the button 21 so that its rear edge 21*a* is hooked on the step 33 is much smaller than the force that would be necessary to hold the button 21 against displacement backwardly by the spring 26. Thus, an intentional medium pressure must be exerted on the button 21 to slide the holder 17 forwardly in the direction of arrow B (FIG. 1) to extend the blade 13 in the direction of arrow A. Once extended, however, a very light pressure inwardly on the button 21 will catch the rear edge 21*a* on the step 33 to hold the blade 13 in the outer position.

The holder 17 is formed with a seat 31 for the blade 13 formed at its rear edge with a step 32 against which normally bears the rear edge 13*a* of the blade 13. Thus a single-edge blade can be extremely securely held by the holder 17.

Thus, with the system according to the instant invention inadvertent non-retraction of the blade 13 is impossible. As soon as the user releases the relatively modest pressure on the button 21, which normally will be held in by the user's righthand thumb, the blade will automatically return to the fully withdrawn inner position.

I claim:

1. A razor knife comprising:

an elongated housing having a front end, a longitudinally forwardly open and longitudinally extending guide, a longitudinally extending and transversely open slot, and a longitudinally forwardly directed holding face;

a blade holder in said housing having a seat for a razor blade;

an actuator exposed at said slot, accessible from outside said housing, and having a longitudinally rearwardly directed actuator face fixed longitudinally relative to said seat, said actuator and holder being longitudinally joined and jointly longitudinally slidable in said guide between a back position with said blade wholly enclosed in said housing and with said actuator face longitudinally behind said holding face and a front position with said blade projecting at least partly longitudinally forwardly from said front end of said housing and with said actuator face slightly longitudinally forward of said holding face, said actuator further being transversely shiftable in said housing between an outer releasing position with said actuator face longitudinally out of line with and capable of longitudinally passing said holding face and an inner holding position with said actuator face longitudinally in line with and incapable of longitudinally passing said holding face;

a spring braced between said holder and said housing and urging said holder and said actuator longitudinally backwardly in said housing toward said back position with a relatively great force; and biasing means between said actuator and said holder for urging said actuator outwardly toward said outer position with a relatively small force.

2. The knife defined in claim 1 wherein said actuator has an inner convex face engaging said housing, said actuator being rockable on said inner concave face on said housing between said inner and outer positions.

3. The knife defined in claim 1 wherein said housing includes a front outer part formed with said slot and a rear insert part carrying said holder and integrally fittable with said front part, said holder being slidable relative to said insert part.

4. The knife defined in claim 3 wherein said insert part is formed with a longitudinally extending space containing said spring.

5. The knife defined in claim 4 wherein said spring is a tension spring having a front end hooked on said holder and a rear end hooked on said insert part.

6. The knife defined in claim 3 wherein said front outer part is formed with a backwardly open recess into which said insert is fittable.

7. The knife defined in claim 6 wherein said front outer part is formed in said recess with a pair of inwardly directed grooves and said insert part is formed with outwardly directed ribs snugly receivable in said grooves.

8. The knife defined in claim 3 wherein said actuator and slot are provided on the left-hand side of said housing seen from above and with said blade directed away from the viewer.

* * * * *